US010518400B2

(12) United States Patent
Furusawa

(10) Patent No.: US 10,518,400 B2
(45) Date of Patent: Dec. 31, 2019

(54) WORK TOOL

(71) Applicant: MAKITA CORPORATION, Anjo-shi, Aichi (JP)

(72) Inventor: Masanori Furusawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 218 days.

(21) Appl. No.: 15/545,972

(22) PCT Filed: Jan. 27, 2016

(86) PCT No.: PCT/JP2016/052392
§ 371 (c)(1),
(2) Date: Jul. 24, 2017

(87) PCT Pub. No.: WO2016/121837
PCT Pub. Date: Aug. 4, 2016

(65) Prior Publication Data

US 2018/0001463 A1 Jan. 4, 2018

(30) Foreign Application Priority Data

Jan. 29, 2015 (JP) ..... 2015-015503

(51) Int. Cl.
*B25D 17/24* (2006.01)
*B25D 11/10* (2006.01)
(Continued)

(52) U.S. Cl.
CPC ..... *B25D 17/24* (2013.01); *B25D 11/062* (2013.01); *B25D 11/10* (2013.01); *B25D 11/125* (2013.01);
(Continued)

(58) Field of Classification Search
CPC ..... B25D 11/00; B25D 11/06; B25D 11/062; B25D 11/10; B25D 11/125; B25D 17/24;
(Continued)

(56) References Cited

U.S. PATENT DOCUMENTS 4,991,664 A * 2/1991 Kolgan ..... B25D 11/125 173/201
6,112,830 A * 9/2000 Ziegler ..... B25D 16/00 173/109
(Continued)

FOREIGN PATENT DOCUMENTS

CN 101130241 A 2/2008
CN 101903133 A 12/2010
(Continued)

OTHER PUBLICATIONS

Dec. 19, 2018 Office Action issued in Japanese Patent Application No. 2015-015503.
(Continued)

*Primary Examiner* — Scott A Smith
(74) *Attorney, Agent, or Firm* — Oliff PLC

(57) ABSTRACT

A work tool includes a driving motor, a rotary shaft member configured to be rotationally driven by the driving motor, a swinging member configured to be caused to swing by rotation of the rotary shaft member, a tool accessory driving mechanism configured to drive a tool accessory by swinging of the swinging member, a body housing the driving motor, the rotary shaft member, the swinging member and the tool accessory driving mechanism, and a vibration reducing mechanism configured to reduce vibration caused in the body. The vibration reducing mechanism includes a dynamic vibration reducer having an elastic member and a weight, and a connecting member connecting the weight and the swinging member. The vibration reducing mechanism is
(Continued)

configured to reciprocate the weight via the connecting member by the swinging of the swinging member.

20 Claims, 9 Drawing Sheets

(51) Int. Cl.
*B25D 11/06* (2006.01)
*B25D 11/12* (2006.01)
*B25F 5/00* (2006.01)

(52) U.S. Cl.
CPC ..... *B25F 5/006* (2013.01); *B25D 11/066* (2013.01); *B25D 2211/061* (2013.01); *B25D 2211/068* (2013.01); *B25D 2217/0088* (2013.01); *B25D 2217/0092* (2013.01); *B25D 2250/335* (2013.01)

(58) Field of Classification Search
CPC ..... B25D 2211/061; B25D 2217/0088; B25D 2217/0092; B25D 2211/068
USPC ... 173/48, 162.1, 162.2, 210, 211, 201, 109, 173/128, 114
See application file for complete search history.

(56) References Cited

U.S. PATENT DOCUMENTS 7,096,973 B2 * 8/2006 Ikuta ..... B25D 11/125 173/162.1
7,252,157 B2 * 8/2007 Aoki ..... B25D 11/125 173/162.2
7,331,407 B2 * 2/2008 Stirm ..... B25D 11/062 173/162.1
2004/0206520 A1 * 10/2004 Ikuta ..... B25D 11/125 173/48
2007/0017684 A1 1/2007 Stirm et al.
2008/0029282 A1 * 2/2008 Ikuta ..... B25D 17/24 173/114
2008/0047723 A1 2/2008 Kamegai et al.
2008/0308287 A1 * 12/2008 Sugiyama ..... B25D 11/125 173/211
2009/0025949 A1 * 1/2009 Aoki ..... B23D 51/16 173/162.1
2010/0270046 A1 10/2010 Schlesak et al.
2012/0118598 A1 5/2012 Iio
2013/0048327 A1 * 2/2013 Machida ..... B25D 11/062 173/162.2

FOREIGN PATENT DOCUMENTS

CN 102421566 A 4/2012
EP 1892062 A2 2/2008
EP 2428323 A1 3/2012
EP 2564986 A2 3/2013
JP 2006-520696 A 9/2006
JP 2008-073836 A 4/2008
JP 2010-250145 A 11/2010
JP 2010-260145 A 11/2010

OTHER PUBLICATIONS

Jun. 5, 2018 Office Action issued in Japanese Patent Application No. 2015-015503.
Aug. 1, 2018 Search Report issued in European Patent Application No. 16743440.6.
Aug. 10, 2017 International Preliminary Report on Patentability issued in International Patent Application No. PCT/JP2016/052392.
Apr. 19, 2016 International Search Report issued in International Patent Application No. PCT/JP2016/052392.
Sep. 3, 2019 Office Action issued in Chinese Patent Application No. 201680007504.3.

* cited by examiner

WORK TOOL

TECHNICAL FIELD

The present invention relates to a work tool which is configured to perform a specified operation on a workpiece by linearly driving a tool accessory.

BACKGROUND ART

Japanese laid-open patent publication (JP-A) No. 2010-250145 discloses a work tool which is provided with a dynamic vibration reducer having a weight disposed on a shaft and elastic members disposed on both sides of the weight.

In this work tool, the weight is forcibly driven by reciprocating movement of an end of one of the elastic members.

SUMMARY OF THE INVENTION

Problems to be Solved by the Invention

This work tool is effective to a certain extent for reducing vibration caused in the work tool. However, further improvement is desired in the mechanism for reducing vibration.

Accordingly, it is an object of the present invention to provide a further rational technique relating to a work tool having a mechanism for reducing vibration.

Embodiment to Solve the Problem

In order to solve the above-described problem, a work tool according to the present invention is provided which is configured to perform a specified operation on a workpiece by linearly driving a tool accessory. The work tool includes a driving motor, a rotary shaft member that is configured to be rotationally driven by the driving motor, a swinging member that is configured to be caused to swing by rotation of the rotary shaft member, a tool accessory driving mechanism that is configured to drive the tool accessory by swinging of the swinging member, a body that houses the driving motor, the rotary shaft member, the swinging member and the tool accessory driving mechanism, and a vibration reducing mechanism that is configured to reduce vibration caused in the body.

Examples of the work tool which is configured to linearly drive the tool accessory may include an electric hammer which is configured to perform a crushing operation on a workpiece such as concrete, and an electric reciprocating saw that is configured to perform a cutting operation on a workpiece such as wood. In this sense, the driving motor, the rotary shaft member, the swinging member and the tool accessory driving mechanism may have various structures according to the work tool to be realized.

For example, when the work tool is realized as an electric hammer, the tool accessory driving mechanism may be formed by a piston which is caused to reciprocate by swinging of the swinging member, and a striking element which is moved by reciprocating of the piston, collides with the tool accessory and drives the tool accessory. In this case, the swinging member and the tool accessory driving mechanism may be configured to rotate on a specified connecting position with respect to each other.

The rotary shaft member may include a rotary body which is provided with an outer peripheral surface having a specified inclination angle with respect to a rotation axis of the rotary shaft member. In this case, the swinging member may be formed by a swinging shaft which is disposed to be rotatable with respect to the rotary body. The swinging shaft may include an annular part that surrounds the rotary body, and a tool accessory driving mechanism connection part that is provided to the annular part. The tool accessory driving mechanism connection part may be formed by a shaft part extending from the annular part. With this structure, the annular part may move following inclination of the outer peripheral surface which changes as the rotary body rotates. Accordingly, the shaft part may be caused to swing in a direction along the rotation axis. The tool accessory driving mechanism may be then driven by a linear motion component of the swinging motion of the shaft part.

In the work tool according to the present invention, the vibration reducing mechanism includes a dynamic vibration reducer having an elastic member and a weight which is biased by the elastic member and which is reciprocatable, and a connecting member that connects the weight and the swinging member. The vibration reducing mechanism is configured to reciprocate the weight via the connecting member by swinging of the swinging member.

In the vibration reducing mechanism, the dynamic vibration reducer can reduce vibration caused in the body by reciprocating movement of the weight which is caused by the vibration. This reciprocating weight is further reciprocated directly and forcibly by the motion of the connecting member which is caused by the swinging of the swinging member. As a result, the work tool according to the present invention can effectively reduce vibration. Further, with the above-described structure, it can also be said that the vibration reducing mechanism according to the present invention includes a mechanism that is configured to forcibly reciprocate the weight by the swinging of the swinging member.

The connecting member may be rotatably connected with respect to the swinging member. In this case, it may be preferable that a region of the swinging member in which a position for connecting the swinging member and the connecting member is provided is opposed to a region of the swinging member in which a position for connecting the swinging member and the tool accessory driving mechanism is provided. In other words, in the case of the swinging member having the above-described structure, the position for connecting the swinging member and the connecting member may be arranged in a region of the annular part which is opposed to the shaft part. This region may form a connecting member connection part in the swinging member. In this structure, for example, in a state in which the tool accessory driving mechanism connection part is turned to one side of the rotation axis by swinging of the swinging member, the connecting member connection part may be turned to the other side opposite to the one side of the rotation axis. Further, in a state in which the swinging member is caused to further swing and the tool accessory driving mechanism connection part is turned to the other side of the rotation axis, the connecting member connection part may be turned to the one side of the rotation axis. In other words, the tool accessory driving mechanism connection part and the connecting member connection part may be moved in opposite phase along with the swinging of the swinging member. Thus, the tool accessory driving mechanism and the weight may be driven in opposite phase along with the swinging of the swinging member, so that vibration can be reduced more effectively.

As another aspect of the work tool according to the present invention, the weight and the connecting member may be connected to be rotatable on a pivot axis with respect to each other.

In the work tool according to the present invention, it may be preferred that the weight is linearly reciprocated. On the other hand, the swinging of the swinging member having the above-described structure may be rotation along the rotation axis. Therefore, the connecting member may need to have a motion converting function of converting the rotation of the swinging member into linear motion of the weight. In the work tool according to this aspect of the invention, with the structure in which the weight and the connecting member can rotate with respect to each other, the connecting member can smoothly linearly reciprocate the weight by the rotation of the swinging member.

As another aspect of the work tool according to the present invention, the tool accessory driving mechanism may define a driving axis, and the weight may be configured to surround the driving axis around the driving axis. In this case, the term "around the driving axis" may not refer to a perfect circle around the driving axis or a circular arc on the perfect circle, but to a "periphery of the driving axis". Further, the manner in which the weight "surrounds the driving axis" may not mean that the weight surrounds all around the driving axis in the periphery of the driving axis. For example, it may be sufficient that the weight is arranged to extend in a specified direction perpendicular to the driving axis and in a direction different from this specified direction and crossing the driving axis.

When the tool accessory driving mechanism is driven, vibration may be caused in a direction along the driving axis. In the work tool according to this aspect, the weight may reciprocate in the periphery of the driving axis, so that the vibration caused in the direction along the driving axis can be efficiently reduced.

As another aspect of the work tool according to the present invention, the weight may be disposed on a shaft extending in a direction parallel to the driving axis and may be configured to slide with respect to the shaft.

In the work tool according to this aspect, the weight can efficiently perform linear reciprocating motion, and the vibration caused in the direction along the driving axis can be efficiently reduced.

As another aspect of the work tool according to the present invention, the rotary shaft member may define a rotation axis, and the connecting member may be configured to surround the rotation axis around the rotation axis. In this case, the term "around the rotation axis" may not refer to a perfect circle around the rotation axis or a circular arc on the perfect circle, but to a "periphery of the rotation axis". In this case, the manner in which the connecting member "surrounds the rotation axis" may not require that the connecting member surrounds all around the rotation axis in the periphery of the rotation axis. For example, it may be sufficient that the connecting member is arranged to extend in a specified direction perpendicular to the rotation axis and in a direction different from this specified direction and crossing the rotation axis.

In the work tool according to this aspect, the connecting member can be efficiently arranged, so that the vibration reducing mechanism can be reduced in size.

As another aspect of the work tool according to the present invention, the connecting member may include a pair of end regions and an intermediate region that is formed between the pair of end regions and connected to the swinging member.

In the work tool according to this aspect, the position for connecting the connecting member and the swinging member with respect to the rotation axis can be arranged on the opposite side to the tool accessory driving mechanism. Therefore, the tool accessory driving mechanism and the weight can be driven in opposite phase by the swinging member, so that the vibration reducing function can be effectively exhibited. Further, in this case, it may be preferable that the end regions of the connecting member and the weight are connected to each other.

In the work tool according to the present invention, the vibration reducing mechanism is configured to reciprocate the weight via the connecting member by swinging of the swinging member. Therefore, as another aspect of the work tool according to the present invention, the vibration reducing mechanism may also serve as an assisting mechanism that is configured to shift the weight from a stationary state to a moving state, a mechanism that is configured to increase an amount of reciprocating movement of the weight, a mechanism that is configured to change a phase in reciprocating movement of the weight, or a mechanism that is configured to control an amount of reciprocating movement of the weight. Further, the connecting member may form a counter weight which is configured to be caused to reciprocate by swinging of the swinging member.

In other words, in the work tool according to this aspect, the vibration reducing mechanism that is configured to exhibit various functions can be provided to be suitable to the work tool to be realized.

Effect of the Invention

According to the present invention, a rational technique can be provided in a work tool having a mechanism that is configured to reduce vibration.

DESCRIPTION OF EMBODIMENT

An embodiment of a work tool according to the present invention is now described with reference to FIGS. 1 to 10. In the embodiment of the present invention, a hammer drill 100 is explained as an example of the work tool. It is noted here, although the hammer drill 100 has a vibration reducing mechanism 200, for the sake of explanation, particularly in FIGS. 1 and 2, the vibration reducing mechanism 200 is illustrated in a simple manner.

Figure 1:
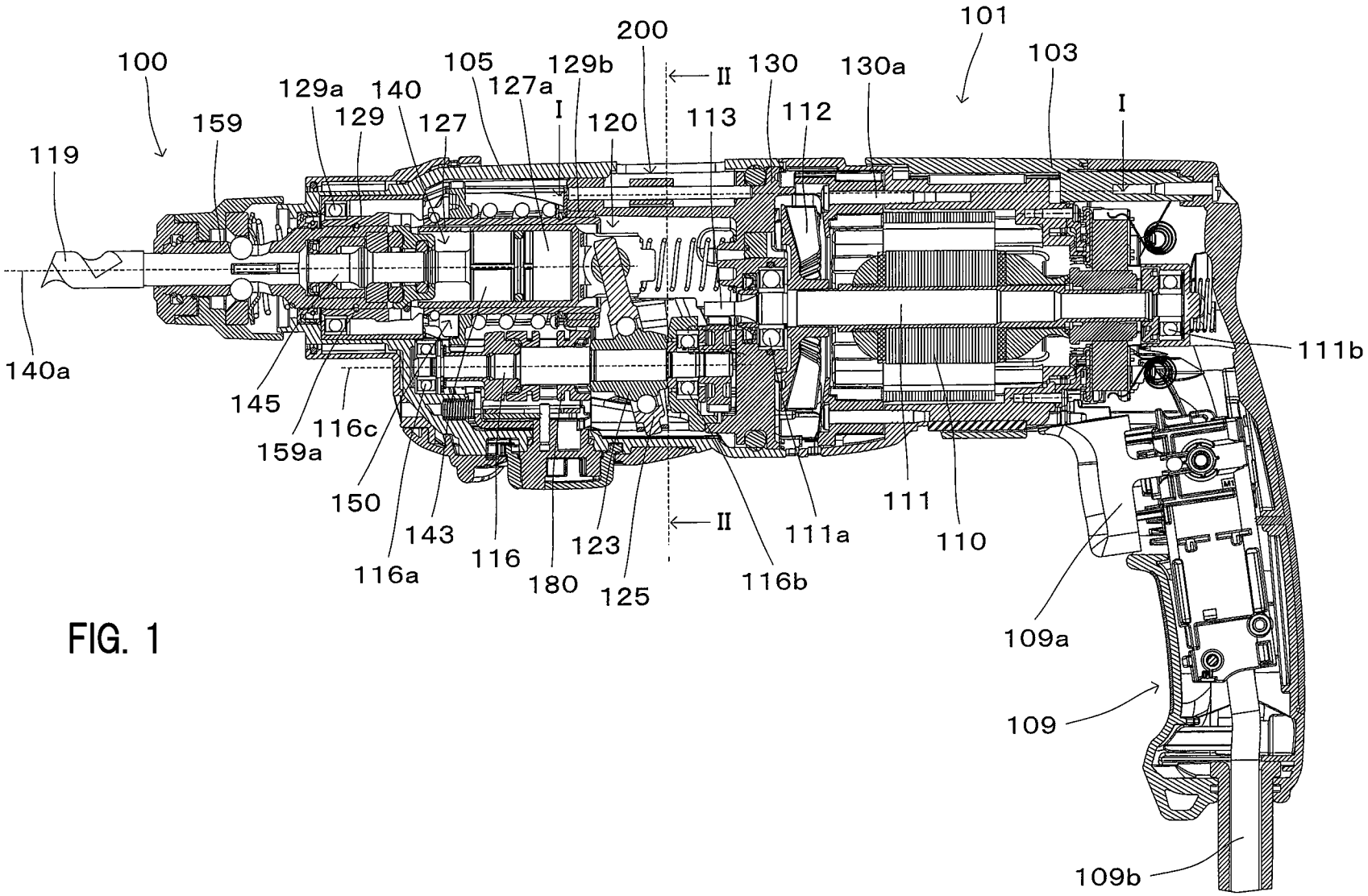
FIG. 1 is a sectional side view of a hammer drill according to an embodiment of the present invention.

FIG. 1 is a sectional view for illustrating the outline of the hammer drill 100. As shown in FIG. 1, the hammer drill 100 is a hand-held work tool having a handgrip 109 designed to be held by a user. The hammer drill 100 is configured to perform hammering motion for a hammering operation on a workpiece by linearly driving a tool bit 119 in an axial direction of the tool bit 119 and to perform rotating motion for a drilling operation on the workpiece by rotationally driving the tool bit 119 around an axis of the tool bit 119. A user can appropriately set a drive mode of the tool bit 119 in the hammer drill 100 by operating a mode change lever (not shown). The hammer drill 100 according to this embodiment has a hammer drill mode in which the tool bit 119 is caused to perform the hammering motion and the rotating motion, and a drill mode in which the tool bit 119 is caused to perform only the rotating motion.

A tool holder 159 is configured to make the tool bit 119 attachable and removable. The tool holder 159 extends in a specified longitudinal direction, and the longitudinal direction of the tool holder 159 defines a body longitudinal direction, which is a longitudinal direction of the hammer drill 100. When the tool bit 119 is coupled to the hammer drill 100, the axial direction of the tool bit 119 is parallel to the body longitudinal direction.

The hammer drill 100 and the tool bit 119 are examples that correspond to the "work tool" and the "tool accessory", respectively, according to the present invention.

In a state of the hammer drill 100 shown in FIG. 1, a front end side of the tool holder 159 in the body longitudinal direction is defined as a front side and a handgrip 109 side opposite to the front side is defined as a rear side. Further, in a direction crossing the body longitudinal direction, the tool holder 159 side is defined as an upper side and the handgrip 109 side is defined as a lower side. Specifically, the left, right, upper and lower sides in FIG. 1 correspond to the front, rear, upper and lower sides of the hammer drill 100, respectively. These definitions relating to the positions according to the attitude of the hammer drill 100 shown in this drawing are also applied to FIGS. 2, 3, 5, 8, 9 and 10.

(Basic Structure of the Hammer Drill)

As shown in FIG. 1, the tool holder 159 is provided on a front end of a body housing 101, and the handgrip 109 designed to be held by a user is provided on a rear end of the body housing 101. A trigger 109*a* for energizing a driving motor 110 is provided on a front side of the handgrip 109. A power cable 109*b* for supplying current to the driving motor 110 is provided on a lower end of the handgrip 109. When a user holds the handgrip 109 and operates the trigger 109*a*, current is supplied to the driving motor 110 through the power cable 109*b* and the tool bit 119 is driven in a specified drive mode.

As shown in FIG. 1, an outer shell of the hammer drill 100 is formed by the body housing 101. The body housing 101 mainly includes a motor housing 103, a gear housing 105 and an inner housing 130. The motor housing 103 and the gear housing 105 form a main part of the outer shell of the hammer drill 100. The body housing 101 is an example that corresponds to the "body" according to the present invention.

As shown in FIG. 1, the driving motor 110 has an output shaft 111. The output shaft 111 is rotatably supported by a bearing 111*a* fixed to the inner housing 130 and a bearing 111*b* fixed to the motor housing 103. A fan 112 and a pinion gear 113 are provided on the output shaft 111 and can rotate together with the output shaft 111. The fan 112 sends air to the driving motor 110 by rotation of the output shaft 111 and cools the driving motor 110. The driving motor 110 is an example that corresponds to the "driving motor" according to the present invention.

(Tool Accessory Driving Mechanism)

Figure 2:
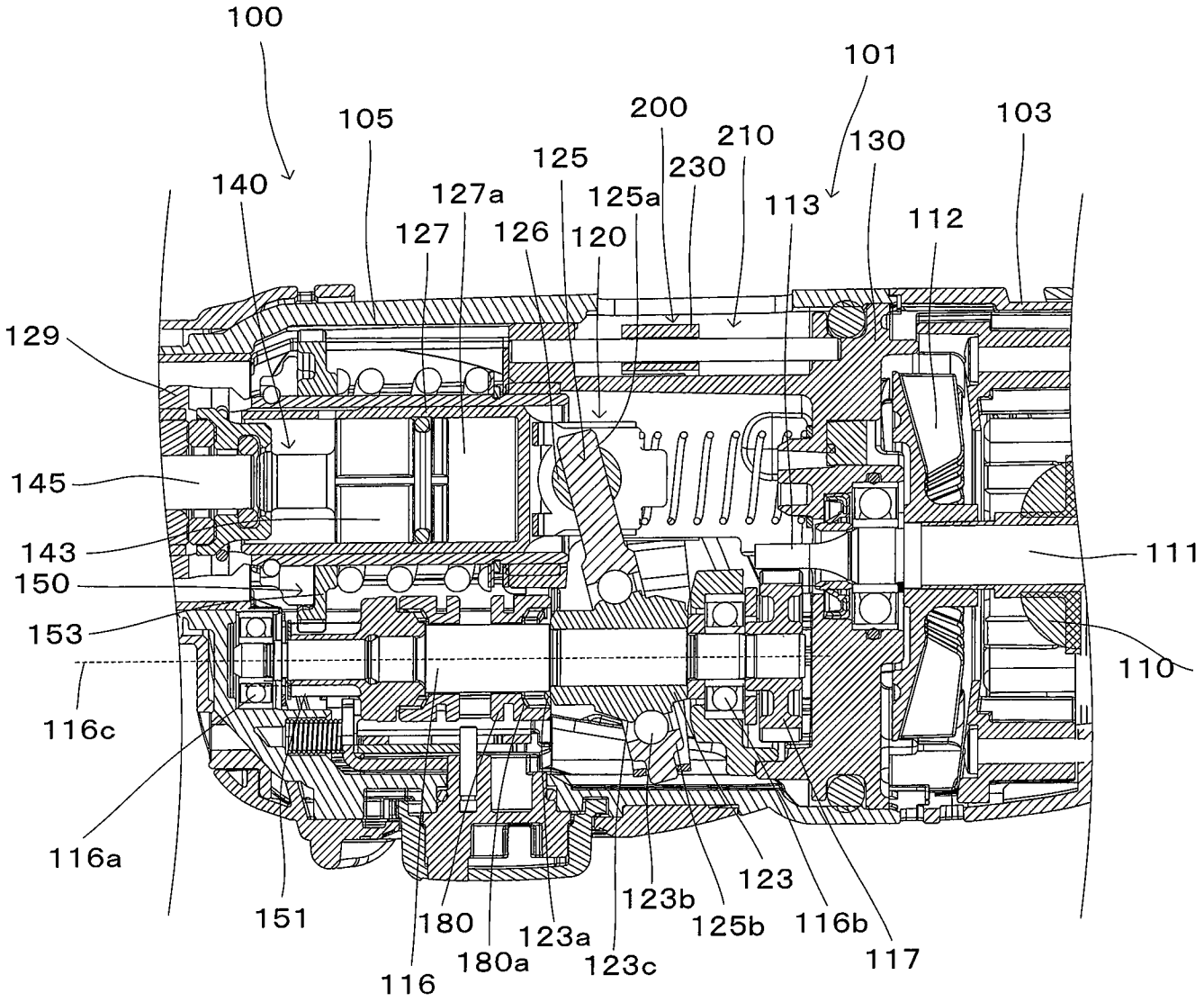
FIG. 2 is an enlarged sectional view showing a main part of a tool accessory driving mechanism.

A structure of a tool accessory driving mechanism that is configured to drive the tool bit 119 within the body housing 101 is now explained with reference to FIGS. 1 and 2. FIG. 2 is an enlarged sectional view for illustrating the tool accessory driving mechanism.

As shown in FIG. 1, the tool accessory driving mechanism mainly includes a motion converting mechanism 120 and a striking mechanism 140 which serve to linearly drive the tool bit 119, and a rotation transmitting mechanism 150 for rotationally driving the tool bit 119. A mechanism formed by the motion converting mechanism 120 and the striking mechanism 140 is an example that corresponds to the "tool accessory driving mechanism" according to the present invention.

(Rotation Transmitting Mechanism)

As shown in FIG. 1, the rotation transmitting mechanism 150 has an intermediate shaft 116 that can rotate on a rotation axis 116*c*. The rotation axis 116*c* is parallel to the output shaft 111 of the driving motor 110 and a striking axis 140*a* (which is described below) defined by the tool accessory driving mechanism. The intermediate shaft 116 and the rotation axis 116*c* are examples that correspond to the "rotary shaft member" and the "rotation axis", respectively, according to the present invention.

As shown in FIG. 1, front and rear end parts of the intermediate shaft 116 are mounted to the gear housing 105 via a bearing 116*a* and a bearing 116*b*, respectively. A driven gear 117, which engages with the pinion gear 113 of the driving motor 110, is provided on the rear end part of the intermediate shaft 116. A first gear 151, which engages with a second gear 153 integrally formed with a sleeve 129, is provided on the front end part of the intermediate shaft 116.

As shown in FIG. 1, the sleeve 129 is integrally connected to the tool holder 159 via a ring spring 159*a*. Further, a front end part of the sleeve 129 is mounted to the gear housing 105 via a bearing 129*a* and a rear end part of the sleeve 129 is mounted to the inner housing 130 via a bearing 129*b*, so that the sleeve 129 is rotatably disposed within the body housing 101.

With this structure, an output of the pinion gear 113 is transmitted to the driven gear 117 and the intermediate shaft 116 is rotated. Then the rotation of the intermediate shaft 116 is transmitted to the sleeve 129 via the first gear 151 and the second gear 153, and the tool bit 119 is rotationally driven together with the tool holder 159.

(Motion Converting Mechanism and Striking Mechanism)

As shown in FIG. 2, the motion converting mechanism 120 mainly includes a clutch cam 180, a rotary body 123 and a swinging shaft 125. The rotary body 123 is configured to rotate with respect to the intermediate shaft 116. The clutch cam 180 is spline-connected to the intermediate shaft 116, so that the clutch cam 180 can move in a direction of the rotation axis 116*c* and is caused to rotate by rotation of the intermediate shaft 116.

More specifically, the clutch cam 180 is moved in a front-rear direction along with user's operation of the mode change lever. Detailed description of the mode change lever is omitted for convenience sake.

When the hammer drill mode is selected with the mode change lever, the clutch cam 180 is moved rearward, and a clutch teeth 180*a* of the clutch cam 180 and a clutch teeth 123*a* of the rotary body 123 engage with each other.

Therefore, in this case, the tool holder 159 is rotationally driven and the rotary body 123 is rotated, so that a piston 127 is driven as described below.

When the drill mode is selected with the mode change lever, the clutch cam 180 is moved forward and the clutch teeth 180*a* of the clutch cam 180 and the clutch teeth 123*a* of the rotary body 123 are disengaged from each other. Therefore, in this case, the tool holder 159 is rotationally driven, but rotation of the intermediate shaft 116 is not transmitted to the rotary body 123, so that the piston 127 is not driven. FIGS. 1 and 2 show the state in the drill mode.

As shown in FIG. 2, the rotary body 123 has an outer peripheral surface 123*c* having a specified inclination angle with respect to the rotation axis 116*c*. The swinging shaft 125 includes: an annular part 125*b* which is mounted on the outer peripheral surface 123*c* of the rotary body 123 via a plurality of steel balls 123*b* and surrounds the rotary body 123; a shaft part 125*a* which protrudes upward from the annular part 125*b* and is connected to the piston 127 via a joint pin 126; and a projection 125*c* which protrudes downward from the opposite side (lower end) of the annular part 125*b* from the shaft part 125*a* and connected to a connecting member 250 which is described below. Further, the shaft part 125*a* and the joint pin 126 are rotatably connected with respect to each other and form a tool accessory driving mechanism connection part. Further, the projection 125*c* and the connecting member 250 are rotatably connected with respect to each other and form a connecting member connecting mechanism. The swinging shaft 125 is an example that corresponds to the "swinging member" according to the present invention. With this structure, the annular part 125*b* moves following inclination of the outer peripheral surface 123*c* which changes as the rotary body 123 rotates. Accordingly, the shaft part 125*a* is caused to swing in the front-rear direction along the rotation axis 116*c*. The tool accessory driving mechanism is then driven as described below by a linear motion component of the swinging motion of the shaft part 125*a*.

Further, the shaft part 125*a* and the projection 125*c* are arranged oppositely to each other with respect to the rotation axis 116*c*. Therefore, the projection 125*c* is turned rearward when the shaft part 125*a* is turned forward, while the projection 125*c* is turned forward when the shaft part 125*a* is turned rearward.

As shown in FIG. 2, the striking mechanism 140 mainly includes: the piston 127 that is formed by a bottomed cylindrical member and slidably disposed in a bore of the sleeve 129; a striking element in the form of a striker 143 that is slidably disposed in a bore of the piston 127; and an intermediate element in the form of an impact bolt 145 that is slidably disposed in a bore of the tool holder 159 and transmits kinetic energy of the striker 143 to the tool bit 119.

An air chamber 127*a* is formed between the bottom of the piston 127 and the striker 143, and the striker 143 is linearly driven by pressure fluctuations caused in the air chamber 127*a* when the piston 127 reciprocates within the sleeve 129. Specifically, when the piston 127 moves forward and compresses air in the air chamber 127*a*, the striker 143 is pushed forward by expansion of the compressed air, collides with the impact bolt 145 and moves the tool bit 119 forward. On the other hand, when the piston moves rearward, the air in the air chamber 127*a* is expanded. Then the striker 143 is retracted rearward by negative pressure of the expanded air. Further, during a processing operation, a tip end of the tool bit 119 is pressed by the user, so that the impact bolt 145 is pushed rearward by a rear end of the tool bit 119. Then, the impact bolt 145 that has been moved rearward is moved forward and collides with the tool bit 119 as described above, when the piston 127 moves forward. By repeating this series of operations, the tool bit 119 is linearly and continuously driven. The above-described operation of the striking mechanism 140 defines the striking axis 140*a* shown in FIG. 1. The striking axis 140*a* is parallel to the rotation axis 116*c*. The striking axis 140*a* is an example that corresponds to the "driving axis" according to the present invention.

(Vibration Reducing Mechanism)

Figure 3:
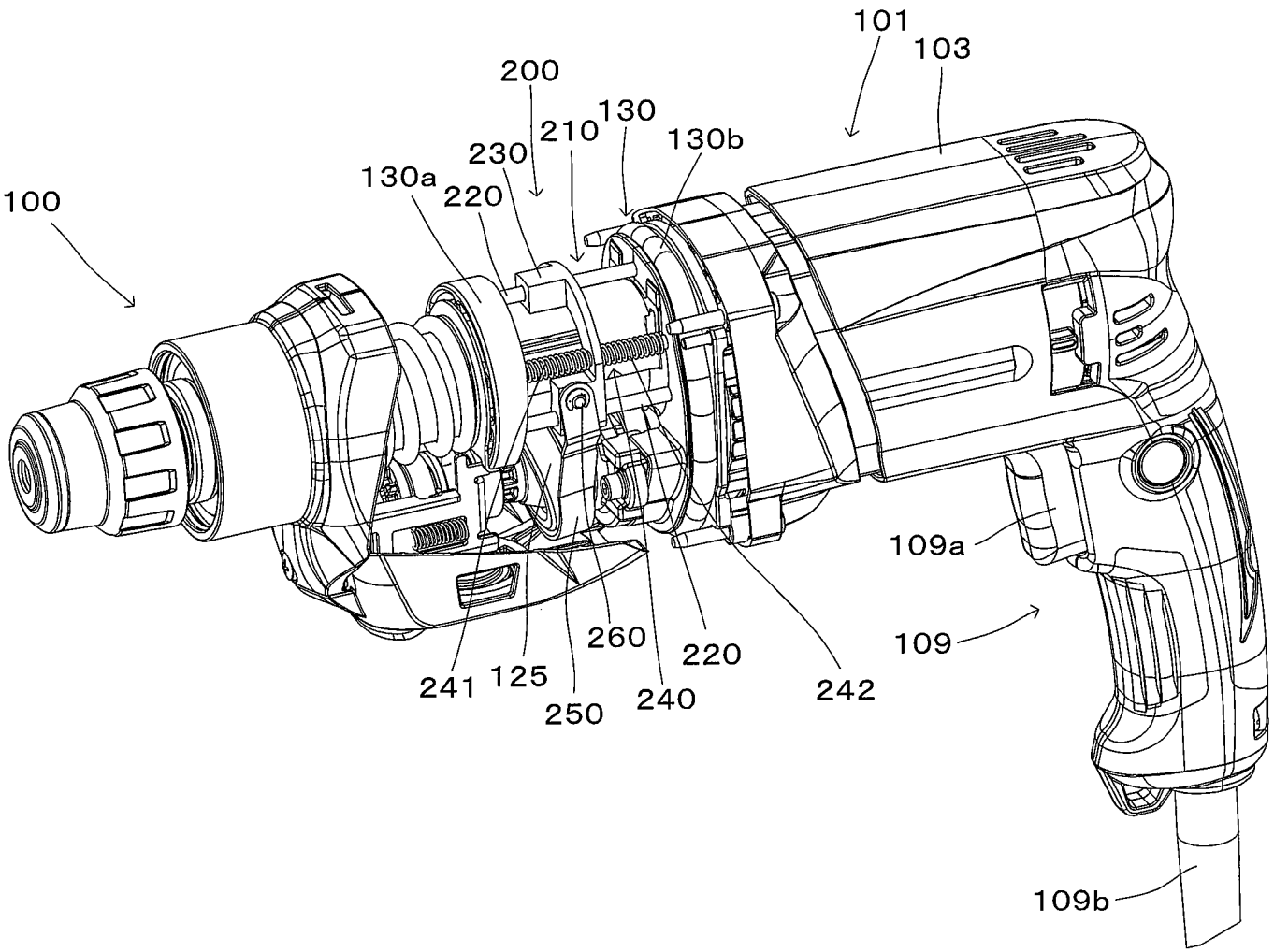
FIG. 3 is an explanatory view for illustrating an outline of a vibration reducing mechanism.

A structure of the vibration reducing mechanism 200 is now explained with reference to FIGS. 3 to 10. FIG. 3 is an explanatory drawing for illustrating a main part of the vibration reducing mechanism 200. As shown in FIG. 3, the vibration reducing mechanism 200 has a dynamic vibration reducer 210 and the connecting member 250. The vibration reducing mechanism 200, the dynamic vibration reducer 210 and the connecting member 250 are examples that correspond to the "vibration reducing mechanism", the "dynamic vibration reducer" and the "connecting member", respectively, according to the present invention.

Figure 4:
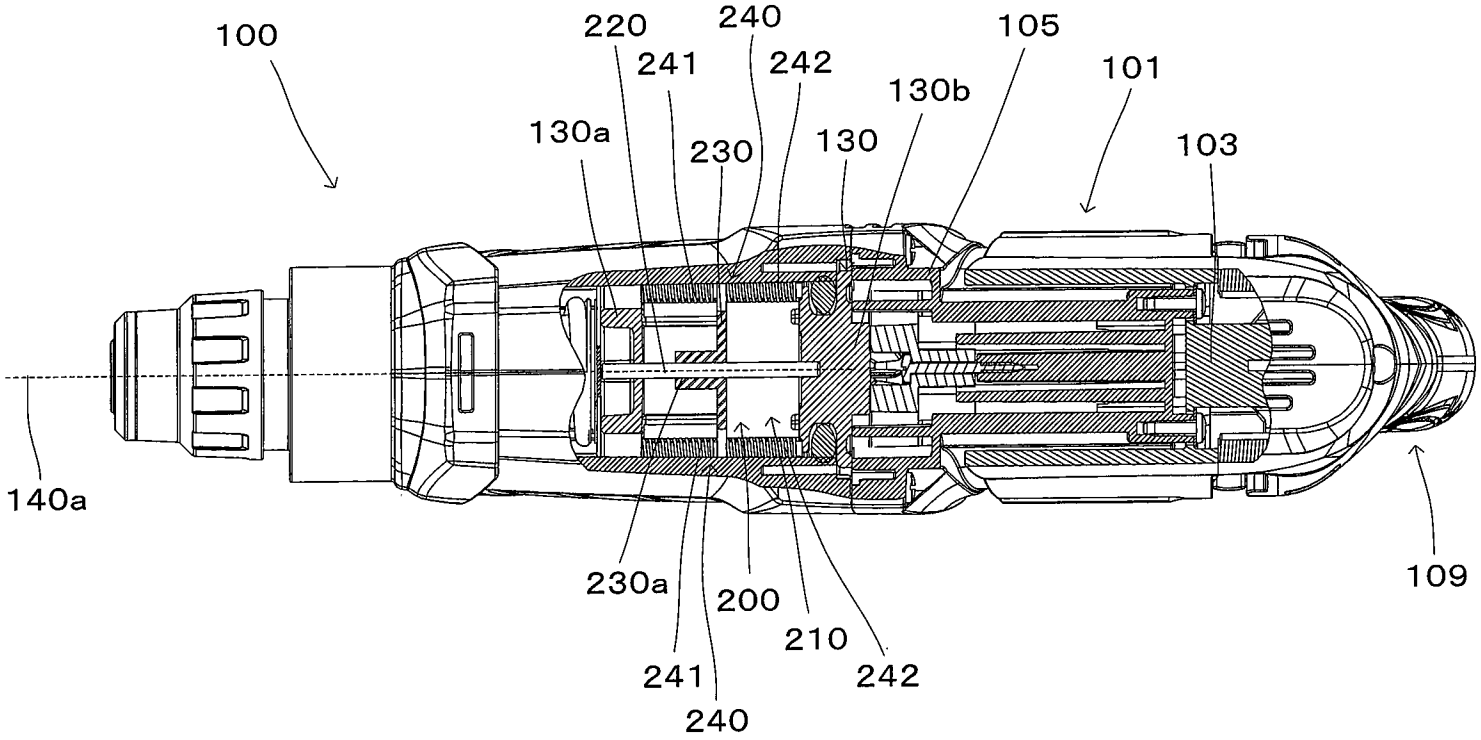
FIG. 4 is a sectional view taken along line I-I in FIG. 1.
Figure 6:
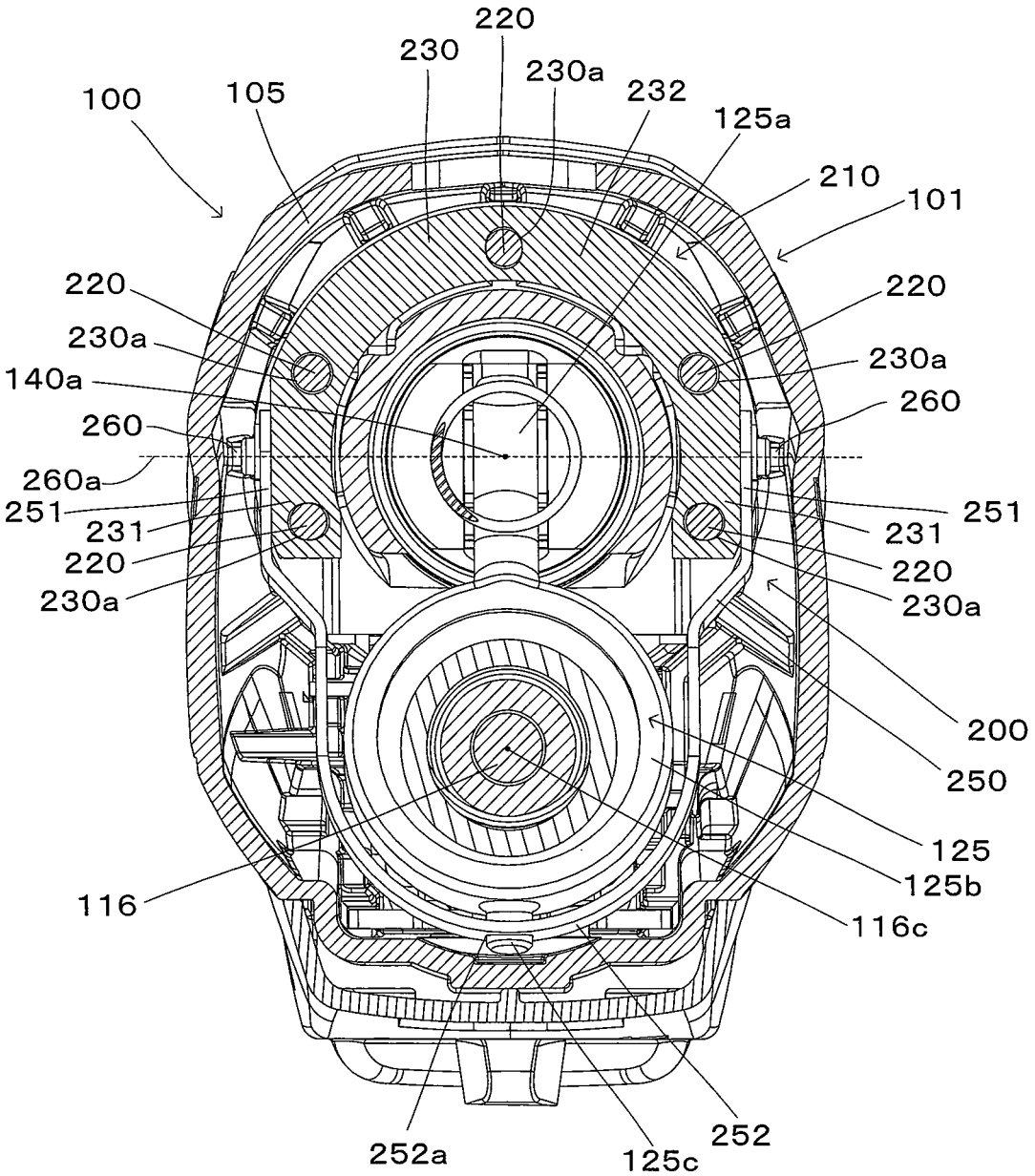
FIG. 6 is a sectional view taken along line in FIG. 1.

FIG. 4 is a sectional view taken along line I-I in FIG. 1. As shown in FIG. 4, the dynamic vibration reducer 210 includes: a plurality of shafts 220 that are arranged to extend between a front part 130*a* and a rear part 130*b* of the inner housing 130; a weight 230 through which the shafts 220 are inserted; and an elastic member 240 for biasing the weight 230. Although five such shafts 220 are used as shown in FIG. 6, any number of the shafts 220 may be selected according to the structure of the dynamic vibration reducer 210 to be realized. Further, the shafts 220 are arranged to extend in parallel to the striking axis 140*a*. The weight 230 has insertion holes 230*a* through which the shafts 220 extend. The shaft 220, the weight 230 and the elastic member 240 are examples that correspond to the "shaft", the "weight" and the "elastic member", respectively, according to the present invention.

Figure 5:
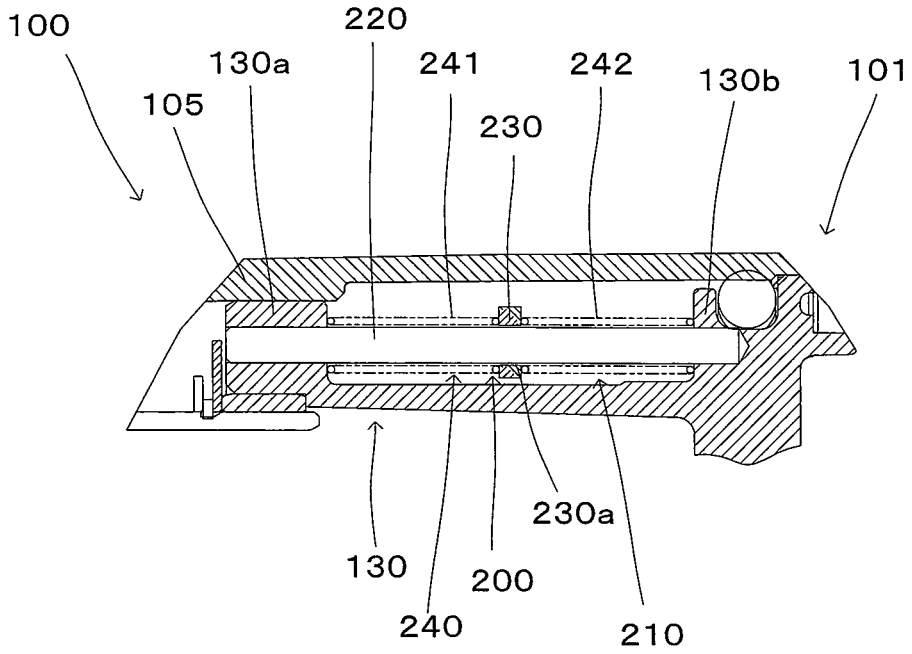
FIG. 5 is an explanatory view for illustrating a structure of a dynamic vibration reducer.

As shown in FIG. 4, it is sufficient for the elastic member 240 to be mounted on one or some of the shafts 220. In this embodiment, the elastic member 240 is provided on each of a pair of the shafts 220 which are arranged oppositely to each other with respect to the striking axis 140*a*. FIG. 5 is an explanatory drawing for illustrating the shaft 220 on which the elastic member 240 is mounted. The elastic member 240 includes a first elastic member 241 disposed between the front part 130*a* of the inner housing 130 and a front side of the weight 230, and a second elastic member 242 disposed between the rear part 130*b* of the inner housing 130 and a rear side of the weight 230. With this structure, the weight 230 can reciprocally slide with respect to the shaft 220.

FIG. 6 is a sectional view taken along line II-II in FIG. 1. As shown in FIG. 6, the weight 230 is arranged to surround the striking axis 140*a* around the striking axis 140*a*. With this structure, the weight 230 is caused to easily reciprocate by vibration which is caused in a direction along the striking axis 140*a* when the striking mechanism 140 is driven. In other words, the dynamic vibration reducer 210 can effectively reduce vibration caused in the direction of the striking axis 140*a*. Further, the weight 230 has a pair of end regions 231 each including an end. A region of the weight 230 between the end regions 231 forms an intermediate region 232.

As shown in FIG. 6, the connecting member 250 is arranged to surround the rotation axis 116*c* around the rotation axis 116*c*. This structure enables efficient arrangement of the connecting member 250 around the rotation axis

116*c*. Further, the connecting member 250 has a pair of end regions 251 each including an end. A region of the connecting member 250 between the end regions 251 forms an intermediate region 252. The end region 251 and the intermediate region 252 are examples that correspond to the "end region" and the "intermediate region", respectively, according to the present invention.

The end regions 251 of the connecting member 250 and the end regions 231 of the weight 230 are connected to rotate on a pivot axis 260*a* with respect to each other. A specific structure of connecting the connecting member 250 and the weight 230 is described below. The intermediate region 252 of the connecting member 250 has an intermediate hole 252*a* through which the projection 125*c* of the swinging shaft 125 is inserted. With this structure, the connecting member 250 may be moved in the front-rear direction by rotation of the swinging shaft 125.

Figure 7:
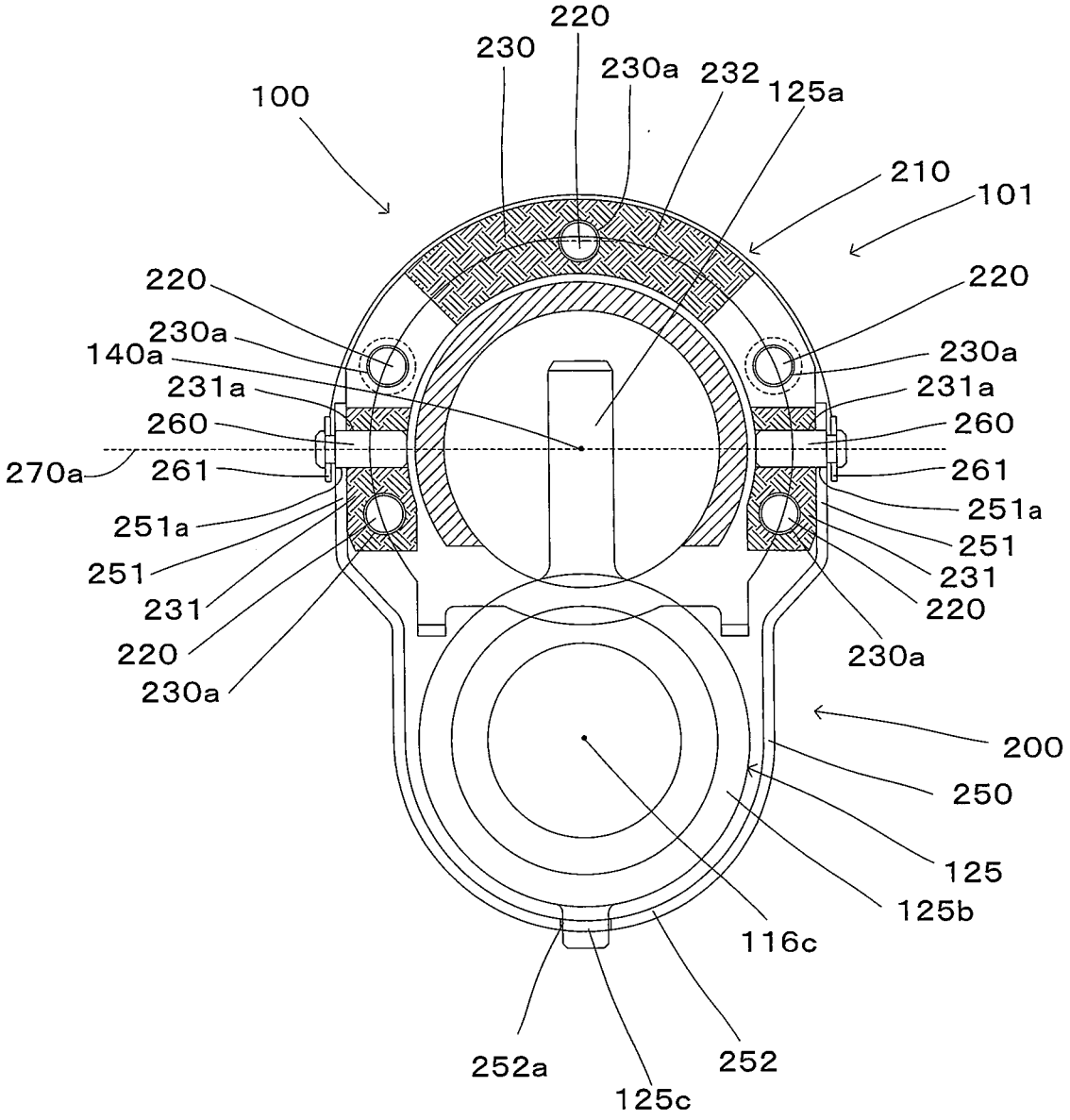
FIG. 7 is an explanatory view for illustrating a structure of the vibration reducing mechanism.

FIG. 7 is an explanatory drawing for showing the structure of connecting the weight 230 and the connecting member 250. As shown in FIG. 7, a circular cylindrical pivot shaft 260 is inserted through an end hole 231*a* formed in each of the end regions 231 of the weight 230 and an end hole 251*a* formed in each of the end regions 251 of the connecting member 250. A recess is formed in a region of the pivot shaft 260 outside of the connecting member 250, and a stopper ring 261 is mounted in the recess to prevent the connecting member 250 from slipping off. With this structure, the weight 230 and the connecting member 250 are configured to rotate on the pivot axis 260*a* with respect to each other. The pivot axis 260*a* is an example that corresponds to the "pivot axis" according to the present invention.

Figure 8:
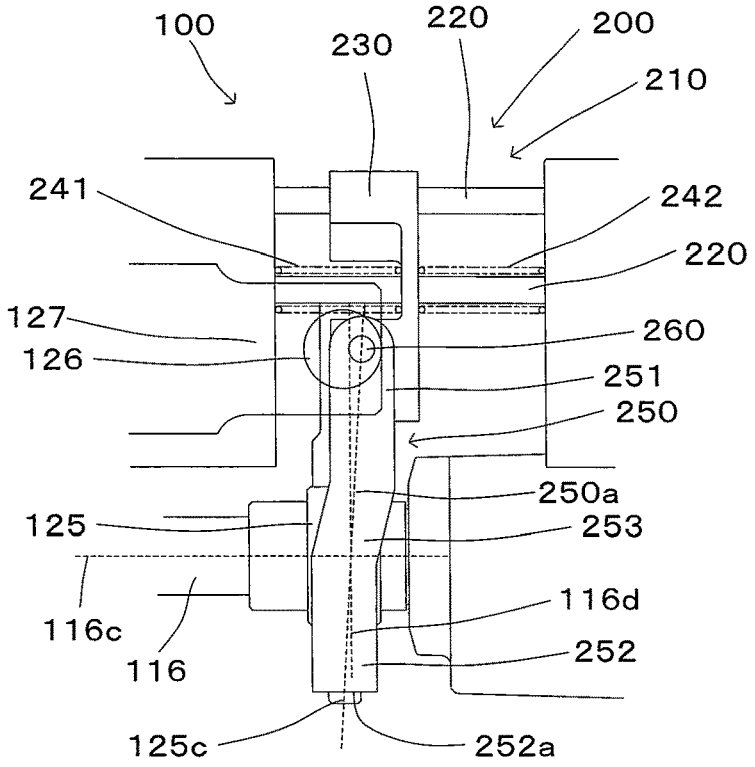
FIG. 8 is an explanatory view for illustrating an operation of the vibration reducing mechanism.
Figure 9:
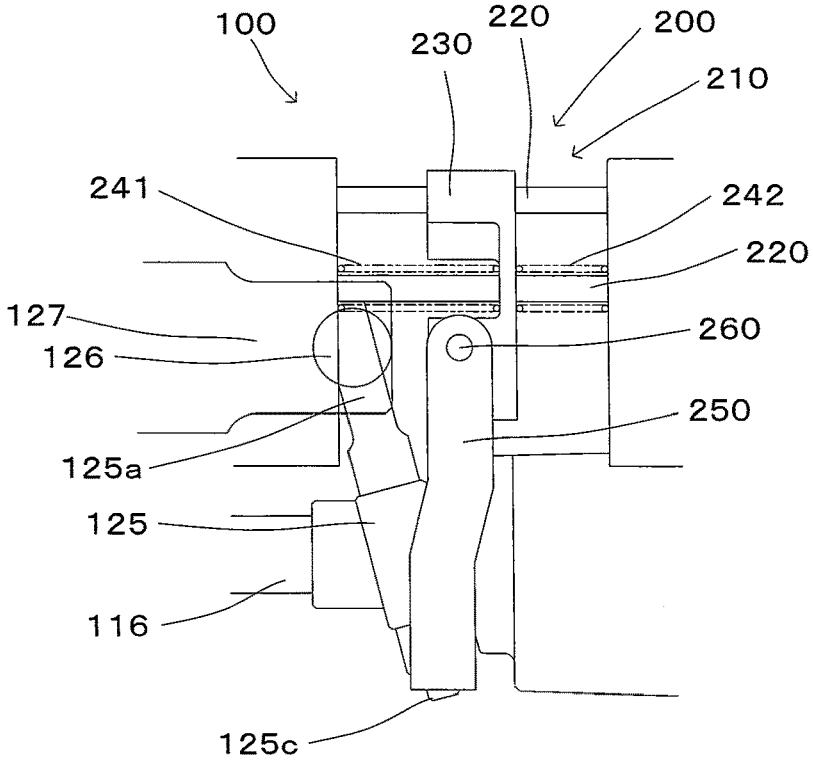
FIG. 9 is an explanatory view for illustrating the operation of the vibration reducing mechanism.

An operation of the vibration reducing mechanism 200 is now explained with reference to FIGS. 8 to 10. FIG. 8 shows a state in which the shaft part 125*a* of the swinging shaft 125 is located to extend in a direction perpendicular to the rotation axis 116*c*. For the sake of explanation, a state of the vibration reducing mechanism 200 shown in FIG. 8 is defined as a first state. As shown in FIG. 8, a center line 250*a* connecting a center point between the pair of pivot shafts 260 and a center point of the intermediate hole 252*a* of the connecting member 250 has a specified inclination angle with respect to a rotation axis orthogonal line 116*d* passing through the center line 250*a* and extending perpendicularly to the rotation axis 116*c*. More specifically, the pivot shafts 260 are arranged rearward of the intermediate hole 252*a*. With such an arrangement of the pivot shafts 260 and the intermediate hole 252*a*, the connecting member 250 has a communication region 253 extending over the end regions 251 and the intermediate region 252. With such a structure of the connecting member 250, the connecting member 250 can be efficiently arranged within a limited space, so that the hammer drill 100 can be reduced in size.

For the sake of explanation, the first state shown in FIG. 8 is defined as an initial state of the vibration reducing mechanism 200. First, a case that the user selects the drill mode in this initial state is explained. In this case, when vibration is caused by driving of the rotation transmitting mechanism 150 or by user's operation of the hammer drill 100, the weight 230 is reciprocated together with the connecting member 250 and thereby reduces the vibration. At this time, the weight 230 linearly reciprocates by sliding on the shaft 220. Further, the pivot shafts 260 reciprocate when the weight 230 linearly reciprocates, so that the connecting member 250 pivots on the intermediate hole 252*a*.

Next, a case that the user selects the hammer drill mode is explained. As described above, in the hammer drill mode, the swinging shaft 125 is caused to swing by rotation of the intermediate shaft 116. FIG. 9 shows a state in which the shaft part 125*a* is inclined forward by rotation of the intermediate shaft 116. This state of the vibration reducing mechanism 200 is defined as a second state.

In the second state, the shaft part 125*a* moves the piston 127 forward and thus the tool bit 119 is moved forward. At this time, the projection 125*c* is inclined rearward, so that the weight 230 is moved rearward via the connecting member 250. In this case, the first elastic member 241 biases the weight 230 and thereby assists rearward movement of the weight 230. Further, the second elastic member 242 is compressed by the weight 230.

Figure 10:
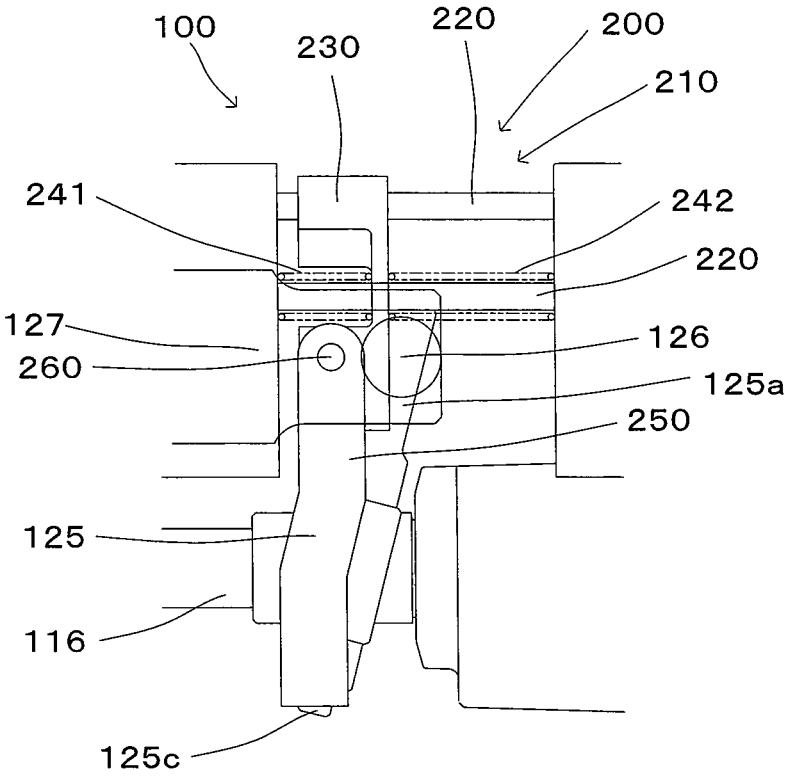
FIG. 10 is an explanatory view for illustrating the operation of the vibration reducing mechanism.

As the intermediate shaft 116 is further rotated, the swinging shaft 125 is caused to swing from the second state to a state in which the shaft part 125*a* is inclined rearward as shown in FIG. 10 via the first state. This state of the vibration reducing mechanism 200 shown in FIG. 10 is defined as a third state.

In the third state, the shaft part 125*a* is inclined rearward and the projection 125*c* is inclined forward. Therefore, the shaft part 125*a* moves the piston 127 rearward, so that the air in the air chamber 127*a* is expanded and the striker 143 is moved rearward. Further, as the tool bit 119 is being pressed against the workpiece by the user, the tool bit 119 is moved rearward together with the impact bolt 145.

Meanwhile, the projection 125*c* is inclined forward, so that the weight 230 is moved forward via the connecting member 250. At this time, the second elastic member 242 biases the weight 230 and thereby assists forward movement of the weight 230. Further, the first elastic member 241 is compressed by the weight 230.

As described above with reference to FIGS. 8 to 10, the vibration reducing mechanism 200 is configured to directly and forcibly reciprocate the weight 230 between the second state and the third state via the first state by swinging of the swinging shaft 125. Therefore, it can be said that the vibration reducing mechanism 200 includes a weight forcibly reciprocating mechanism.

Further, as the vibration reducing mechanism 200 is configured to forcibly move the weight 230 along with the swinging of the swinging shaft 125, it can be said that the vibration reducing mechanism 200 serves as an assisting mechanism that is configured to shift the weight 230 from a stationary state to a moving state.

Further, in the dynamic vibration reducer 210 formed only by the weight 230 and the elastic member 240, the weight 230 can be reciprocated only by vibration caused in the body housing 101. Therefore, the reciprocating distance of the weight 230 may depend on the magnitude of vibration caused in the body housing 101.

In the vibration reducing mechanism 200 according to the present invention, however, the weight 230 is forcibly reciprocated between the second state and the third state as described above via the connecting member 250. Specifically, in a state in which the amount of reciprocating movement of the weight 230 is small in the dynamic vibration reducer 210 formed only by the weight 230 and the elastic member 240, it can be said that the vibration reducing mechanism 200 forms a mechanism that is configured to increase the amount of reciprocating movement of the weight 230. Further, in a state in which the amount of reciprocating movement of the weight 230 is large in the dynamic vibration reducer 210 formed only by the weight 230 and the elastic member 240, it can also be said that the vibration reducing mechanism 200 forms a mechanism that is configured to control the amount of reciprocating movement of the weight 230.

The connecting member 250 in the vibration reducing mechanism 200 according to the present invention is configured to rotate with respect to both the weight 230 and the swinging shaft 125, so that the connecting member 250 can linearly reciprocate the weight 230 by swinging of the swinging shaft 125. Further, with the structure in which the connecting member 250 can rotate with respect to both the weight 230 and the swinging shaft 125, it can also be said that the vibration reducing mechanism 200 forms a mechanism that is configured to change a phase in the reciprocating movement of the weight 230.

Further, it can also be said that the connecting member 250 which is caused to reciprocate by swinging of the swinging shaft 125 forms a counter weight.

Therefore, the vibration reducing mechanism 200 according to the present invention, which is configured to exhibit various functions, can be provided to be suitable to the work tool 100 to be realized.

The above-described embodiment is explained as an example of the invention, but the work tool according to the present invention may have other structures. For example, an electric reciprocating saw which is configured to perform a cutting operation on a workpiece such as wood by linearly driving the tool accessory may be used as the work tool. Further, the handgrip 109 is formed in a cantilever shape extending downward, but the handgrip 109 may be formed in a loop shape. Further, the output shaft 111 of the electric motor 110 is arranged in parallel to the rotation axis 116*c*, but the output shaft 111 may be arranged to cross the rotation axis 116*c*. In this case, the output shaft 111 and the intermediate shaft 116 may preferably be engaged with each other via a bevel gear.

In view of the nature of the above-described invention, the work tool according to the present invention can be provided with the following features. Each of the features can be used separately or in combination with another feature, or in combination with the claimed invention.

(Aspect 1)

The rotary shaft member includes a rotary body having an outer peripheral surface having a specified inclination angle with respect to the rotation axis, and the swinging shaft includes an annular part that is disposed to be rotatable with respect to the outer peripheral surface, a shaft part that is provided to protrude from the annular part and rotatably connected with respect to the tool accessory driving mechanism, and a projection that is provided to protrude from the opposite side of the annular part to the shaft part and rotatably connected with respect to the connecting member.

(Aspect 2)

The vibration reducing mechanism includes a first connection part that connects the swinging member and the tool accessory driving mechanism such that the swinging member and the tool accessory driving mechanism are rotatable with respect to each other, and a second connection part that connects the swinging member and the connecting member such that the swinging member and the connecting member are rotatable with respect to each other.

(Aspect 3)

The first and second connection parts can be arranged oppositely to each other with respect to the rotation axis.

(Correspondences Between the Features of the Embodiment and the Features of the Invention)

Correspondences between the features of the embodiment and the features of the invention are as follows. It is noted that the above-described embodiment is an example for embodying the present invention, and the present invention is not limited to the structure of the above-described embodiment.

The hammer drill 100 is an example that corresponds to the "work tool" according to the present invention. The tool bit 119 is an example that corresponds to the "tool accessory" according to the present invention. The body housing 101 is an example that corresponds to the "body" according to the present invention. The driving motor 110 is an example that corresponds to the "driving motor" according to the present invention. The intermediate shaft 116 is an example that corresponds to the "rotary shaft member" according to the present invention. The rotation axis 116*c* is an example that corresponds to the "rotation axis" according to the present invention. The swinging shaft 125 is an example that corresponds to the "swinging member" according to the present invention. The striking axis 140*a* is an example that corresponds to the "driving axis" according to the present invention. The vibration reducing mechanism 200 is an example that corresponds to the "vibration reducing mechanism" according to the present invention. The dynamic vibration reducer 210 is an example that corresponds to the "dynamic vibration reducer" according to the present invention. The connecting member 250 is an example that corresponds to the "connecting member" according to the present invention. The shaft 220 is an example that corresponds to the "shaft" according to the present invention. The weight 230 is an example that corresponds to the "weight" according to the present invention. The elastic member 240 is an example that corresponds to the "elastic member" according to the present invention. The end region 251 is an example that corresponds to the "end region" according to the present invention. The intermediate region 252 is an example that corresponds to the "intermediate region" according to the present invention. The pivot axis 260*a* is an example that corresponds to the "pivot axis" according to the present invention.

DESCRIPTION OF THE NUMERALS

100 hammer drill (work tool)
101 body housing (body)
103 motor housing
105 gear housing
109 handgrip
109*a* trigger
109*b* power cable
110 driving motor
111 output shaft
111*a* bearing
111*b* bearing
112 fan
113 pinion gear
116 intermediate shaft (rotary shaft member)
116*a* bearing
116*b* bearing
116*c* rotation axis
116*d* rotation axis orthogonal line
117 driven gear
119 tool bit (tool accessory)
120 motion converting mechanism
123 rotary body
123*a* clutch teeth
123*b* steel ball
123*c* outer peripheral surface
125 swinging shaft (swinging member)
125*a* shaft part

125*b* annular part
125*c* projection
126 joint pin
127 piston
127*a* air chamber
129 sleeve
129*a* bearing
129*b* bearing
130 inner housing
130*a* front part
130*b* rear part
140 striking mechanism
140*a* striking axis
143 striker
145 impact bolt
150 rotation transmitting mechanism
151 first gear
153 second gear
159 tool holder
159*a* ring spring
180 clutch cam
180*a* clutch teeth
200 vibration reducing mechanism
210 dynamic vibration reducer
220 shaft
230 weight
230*a* insertion hole
231 end region
231*a* end hole
232 intermediate region
240 elastic member
241 first elastic member (elastic member)
242 second elastic member (elastic member)
250 connecting member
250*a* center line
251 end region
251*a* end hole
252 intermediate region
252*a* intermediate hole
253 communication region
260 pivot shaft
260*a* pivot axis
261 stopper ring

The invention claimed is:

1. A work tool configured to perform an operation on a workpiece by linearly driving a tool accessory, the work tool comprising:

a driving motor, a rotary shaft member configured to be rotationally driven by the driving motor, a swinging member configured to be caused to swing by rotation of the rotary shaft member, a tool accessory driving mechanism configured to drive the tool accessory by swinging of the swinging member, a body housing the driving motor, the rotary shaft member, the swinging member and the tool accessory driving mechanism, and a vibration reducing mechanism configured to reduce vibration caused in the body, wherein:

the vibration reducing mechanism includes:

a dynamic vibration reducer having an elastic member and a weight, the weight being biased by the elastic member and being reciprocatable; and a connecting member directly connected to the weight and the swinging member such that movement of the swinging member is directly conveyed to the weight via the connecting member; and the vibration reducing mechanism is configured to reciprocate the weight via the connecting member by the swinging of the swinging member.

2. The work tool as defined in claim 1, wherein the weight and the connecting member are connected to be rotatable on a pivot axis with respect to each other.

3. The work tool as defined in claim 1, wherein the tool accessory driving mechanism defines a driving axis, and the weight is configured to surround the driving axis around the driving axis.

4. The work tool as defined in claim 1, wherein the weight is disposed on a shaft and configured to slide with respect to the shaft, the shaft extending in a direction parallel to the driving axis.

5. The work tool as defined in claim 1, wherein the rotary shaft member defines a rotation axis, and the connecting member is configured to surround the rotation axis around the rotation axis.

6. The work tool as defined in claim 5, wherein the connecting member has a pair of end regions and an intermediate region, the intermediate region being formed between the pair of end regions and being connected to the swinging member.

7. The work tool as defined in claim 1, wherein the vibration reducing mechanism also serves as an assisting mechanism configured to move the weight from a stationary state by reciprocating the weight via the connecting member along with the swinging of the swinging member.

8. The work tool as defined in claim 1, wherein the vibration reducing mechanism also serves as a mechanism configured to increase an amount of reciprocating movement of the weight by reciprocating the weight via the connecting member along with the swinging of the swinging member.

9. The work tool as defined in claim 1, wherein the vibration reducing mechanism also serves as a mechanism configured to change a phase in reciprocating movement of the weight by reciprocating the weight via the connecting member along with the swinging of the swinging member.

10. The work tool as defined in claim 1, wherein the vibration reducing mechanism also serves as a mechanism configured to control an amount of reciprocating movement of the weight by reciprocating the weight via the connecting member along with the swinging of the swinging member.

11. The work tool as defined in claim 1, wherein the connecting member forms a counter weight configured to be caused to reciprocate along with the swinging of the swinging member.

12. The work tool defined in claim 1, wherein:

the elastic member includes a first elastic unit and a second elastic unit; and the weight is positioned between the first elastic unit and the second elastic unit.

13. The work tool defined by claim 1, wherein the connecting member has arms that are connected to the weight on opposite sides of the weight.

14. The work tool defined by claim 13, wherein connections of the arms to the weight are diametrically opposite each other on a cylinder defined by the weight.

15. A work tool configured to perform an operation on a workpiece by linearly driving a tool accessory, the work tool comprising:

a driving motor, a rotary shaft member configured to be rotationally driven by the driving motor, a swinging member configured to be caused to swing by rotation of the rotary shaft member, a tool accessory driving mechanism configured to drive the tool accessory by swinging of the swinging member, a body housing the driving motor, the rotary shaft member, the swinging member and the tool accessory driving mechanism, and a vibration reducing mechanism configured to reduce vibration caused in the body, wherein:

the vibration reducing mechanism includes:

a dynamic vibration reducer having an elastic member and a weight, the weight being biased by the elastic member and being reciprocatable; and a connecting member connected to the weight and the swinging member such that movement of the swinging member is forcibly conveyed to the weight via the connecting member; and the vibration reducing mechanism is configured to reciprocate the weight via the connecting member by the swinging of the swinging member.

16. The work tool as defined in claim 15, wherein the weight and the connecting member are connected to be rotatable on a pivot axis with respect to each other.

17. The work tool as defined in claim 15, wherein the tool accessory driving mechanism defines a driving axis, and the weight is configured to surround the driving axis around the driving axis.

18. The work tool as defined in claim 15, wherein the weight is disposed on a shaft and configured to slide with respect to the shaft, the shaft extending in a direction parallel to the driving axis.

19. The work tool as defined in claim 15, wherein the rotary shaft member defines a rotation axis, and the connecting member is configured to surround the rotation axis around the rotation axis.

20. The work tool as defined in claim 15, wherein the vibration reducing mechanism also serves as an assisting mechanism configured to move the weight from a stationary state by reciprocating the weight via the connecting member along with the swinging of the swinging member.

* * * * *